US005483766A

United States Patent [19]

Hochstrate et al.

[11] Patent Number: 5,483,766

[45] Date of Patent: Jan. 16, 1996

[54] COMBINED HANDGRIP AND TRIGGER GUARD FOR A FIREARM

[75] Inventors: Paul M. Hochstrate, Plantsville; Michael E. Gamache, Tolland, both of Conn.

[73] Assignee: Colt's Manufacturing Company Inc., West Hartford, Conn.

[21] Appl. No.: 333,284

[22] Filed: Nov. 2, 1994

[51] Int. Cl.[6] ..... F41A 11/00

[52] U.S. Cl. ..... 42/75.03; 42/71.02

[58] Field of Search ..... 42/71.02, 75.03

[56] References Cited

U.S. PATENT DOCUMENTS

| | | | |
|---|---|---|---|
| D. 347,256 | 5/1994 | Strayer et al. | D22/108 |
| 2,832,266 | 4/1958 | Sunderland | 89/195 |
| 3,150,458 | 9/1964 | Browning | 42/75 |
| 3,188,763 | 6/1965 | Duncan | 42/16 |
| 3,788,191 | 1/1974 | Rose et al. | 89/155 |
| 4,242,824 | 1/1981 | Pachmayr et al. | 42/75.03 |
| 4,473,964 | 10/1984 | Straub et al. | 42/75.03 |
| 4,562,659 | 1/1986 | Neta | 42/75.03 |
| 4,630,387 | 12/1986 | Crane et al. | 42/73 |
| 5,293,708 | 3/1994 | Strayer et al. | 42/75.03 |

*Primary Examiner*—Charles T. Jordan
*Assistant Examiner*—Christopher K. Montgomery
*Attorney, Agent, or Firm*—Perman & Green

[57] ABSTRACT

A combined handgrip and trigger guard for a firearm has a handgrip section and a trigger guard section. Preferably, the handgrip section and trigger guard section are provided as an integral one-piece polymer member. The trigger guard section extends from the handgrip section in a general cantilevered configuration. A free end of the cantilever trigger guard section has an integral pin section that is located in a hole of a frame of the firearm. Locating the free end of the trigger guard section against the frame with the pin section in the hole of the frame is the only direct connection of the trigger guard section to the frame and does not use additional fasteners directly between the trigger guard section and the frame.

22 Claims, 2 Drawing Sheets

COMBINED HANDGRIP AND TRIGGER GUARD FOR A FIREARM

BACKGROUND OF THE INVENTION

1. Field of the Invention

The present invention relates to firearms and, more particularly, to a handgrip and trigger guard for a firearm.

2. Prior Art

U.S. Pat. No. 5,293,708 discloses a frame and handgrip assembly for an autoloading handgun. The handgrip structure has a trigger guard portion that is integral to the handgrip portion. The structure is made as a one-piece polymer member. U.S. Pat. Des. No. 347,256 shows a design of a combined grip and trigger guard for a handgun. U.S. Pat. No. 2,832,266 shows a grip of a pistol attached to a frame by a single screw. U.S. Pat. No. 3,188,763 discloses a pistol with a housing having a grip and trigger guard.

SUMMARY OF THE INVENTION

In accordance with one embodiment of the present invention a firearm combined handgrip and trigger guard is provided comprising a handgrip section and a trigger guard section. The trigger guard section extends from the handgrip section in a general cantilevered configuration. A free end of the cantilever trigger guard section is adapted to be connected to a frame of the firearm.

In accordance with another embodiment of the present invention a combined handgrip and trigger guard for a firearm is provided comprising a handgrip section and a trigger guard section. The trigger guard section is integrally formed with the hand grip section as a one piece polymer member. The trigger guard section has an integral pin section extending therefrom for mounting in an aperture of a frame of the firearm.

In accordance with another embodiment of the present invention a firearm is provided comprising a frame and a one piece handgrip and trigger guard member. The member has a handgrip section and a trigger guard section. The trigger guard section is connected to the frame indirectly by the handgrip section and, an integral pin on an end of the trigger guard section is directly connected to the frame by being merely located in an aperture of the frame without use of additional fasteners directly between the trigger guard section and the frame.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
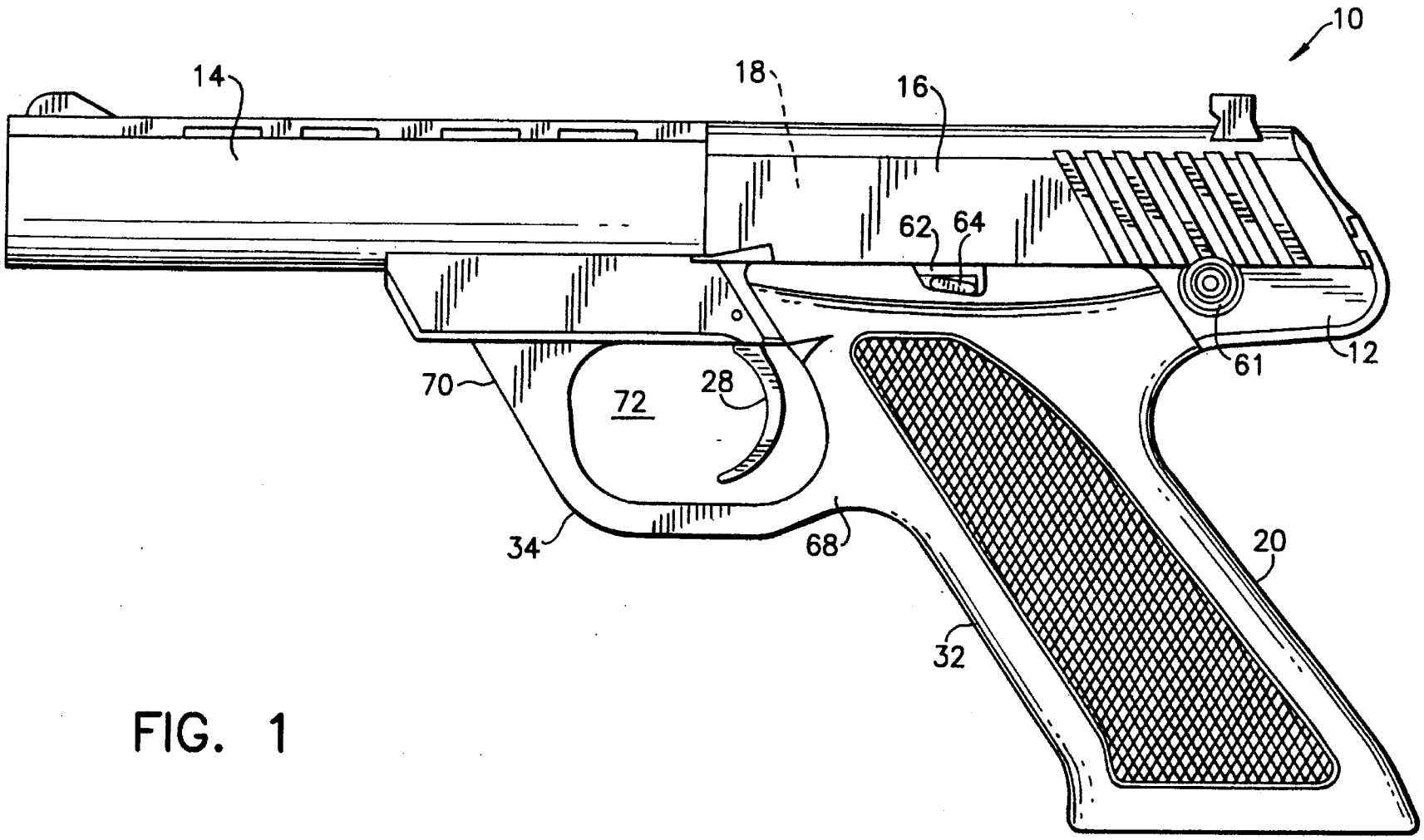
FIG. 1 is an elevational side view of a firearm incorporating features of the present invention.

Referring to FIG. 1, there is shown a pistol 10 incorporating features of the present invention. Although the present invention will be described with reference to the single embodiment shown in the drawings, it should be understood that features of the present invention can be embodied in various different alternative forms of embodiment. In addition, any suitable size, shape or type of features or materials could be used.

Figure 2:
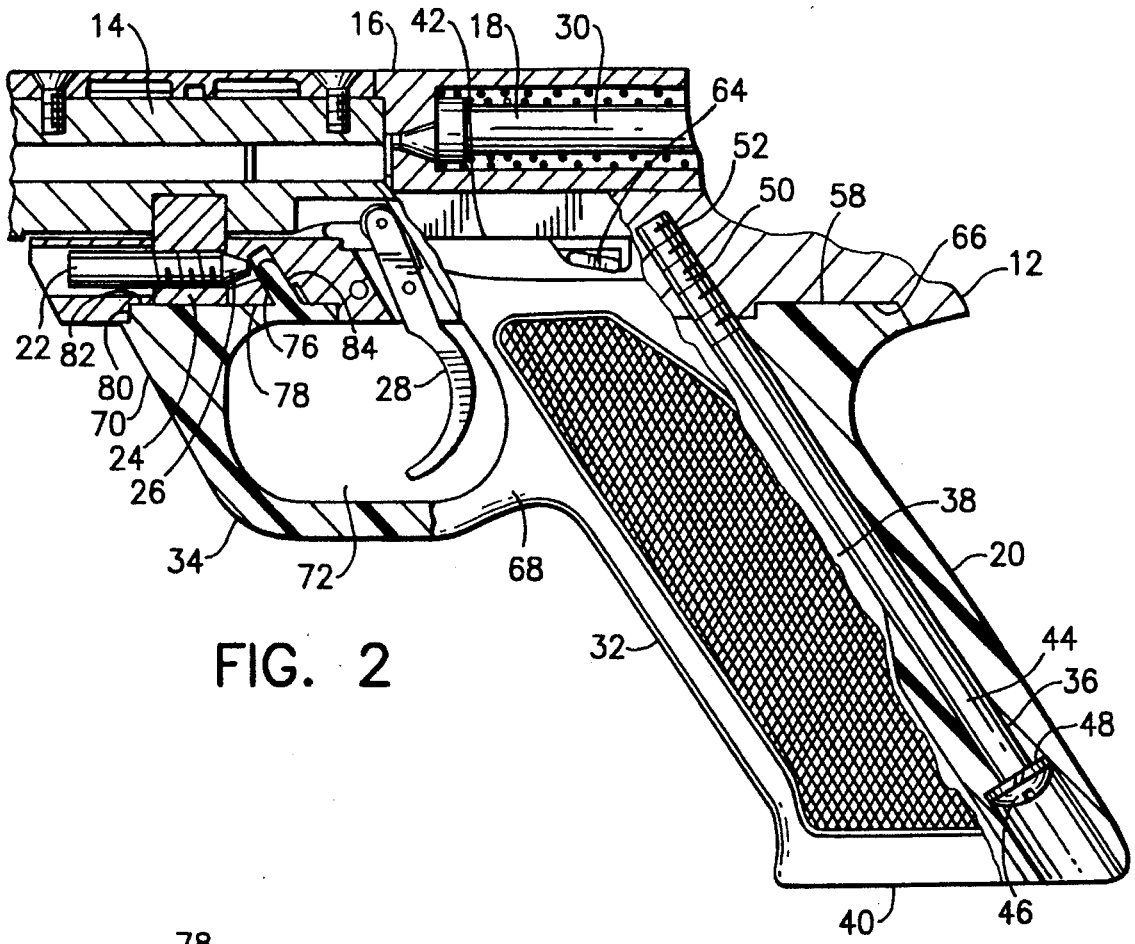
FIG. 2 is a partial elevational side view of the firearm shown in FIG. 1 with a cut-away section.

The pistol 10 is a semi-automatic pistol which generally comprises a frame 12, a barrel 14, a slide 16, a firing mechanism 18, and a combined handgrip and trigger guard 20. The frame 12, barrel 14, and slide 16 are preferably comprised of metal, but any suitable material could be used. Referring also to FIG. 2, the barrel 14 is stationarily attached to the frame 12 by a screw 22 in a fashion which is similar to that disclosed in U.S. Pat. No. 3,150,458 which is hereby incorporated by reference. The screw 22 is threaded in block 24 and pushes the block 24 and attached barrel 14 forward by the action of the nose 26 of the screw 22 pressing against the frame 12. The slide 16 is movably attached to the frame 12 between a forward battery position and a rearward casing/cartridge ejection position, similar to the slide shown in U.S. Pat. No. 3,150,458. The firing mechanism 18 includes a trigger 28 and a striker 30. In alternate embodiments, other types of barrels, frames, slides and/or firing mechanisms could be used. In addition, the present invention could be used with firearms other than semi-automatic pistols.

The combined handgrip and trigger guard 20 is preferably comprised of a one-piece molded polymer or plastic member. However, the member 20 could be comprised of other materials and, could be comprised of multiple members that are fixedly attached to each other. The member 20 generally comprises a handgrip section 32 and an integral trigger guard section 34. The handgrip section 32 has a first channel 36 and a second channel 38. The first channel 36 extends from the bottom 40 to the top 42 of the handgrip section 32. The first channel 36 is suitable sized and shaped to have a fastener 44 located therein. In the embodiment shown, the fastener is an elongate bolt.

The head 46 of the fastener 44 abuts against a shelf 48 in the first channel 36. The opposite threaded end 50 of the fastener 44 is threadingly located in hole 52 of the frame 12. In alternate embodiments, other types of fasteners could be used. The second channel 38 is suitably sized and shaped to removably receive a cartridge magazine (not shown). The second channel 38 is open at the bottom 40 for insertion and removal of the magazine and, open at the top 42 to dispense cartridges from the magazine. Other than described above, the sides of the handgrip section 32 substantially enclose the channels 36, 38.

Figure 3:
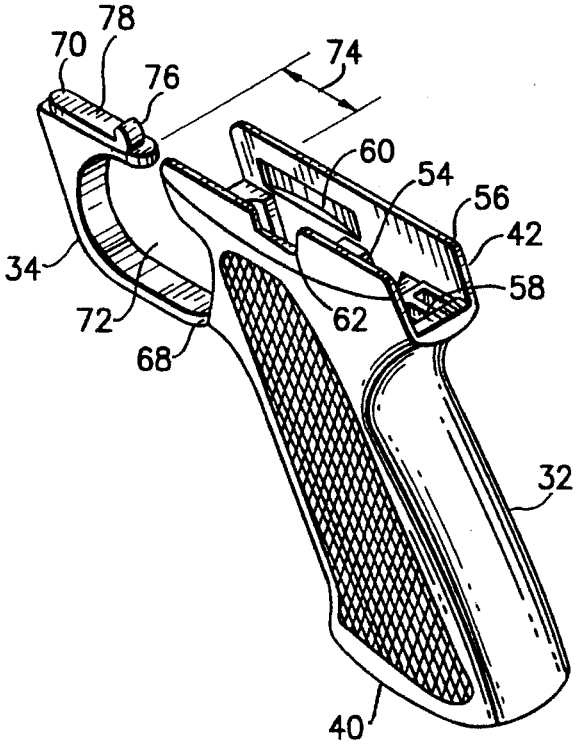
FIG. 3 is a rear, left and top perspective view of the combined handgrip and trigger guard of the firearm shown in FIG. 1.

Referring also to FIG. 3, located at the top 42 of the handgrip section 32 are two side upper extensions 54, 56 and a raised rear block-like projection 58. The right side upper extension 56 has a notch 60 along its interior side that is adapted to accommodate movement of a portion of a magazine release (not shown) therein. The left side upper extension 54 has a notch 62 therethrough. The notch is adapted to accommodate the slide release lever 64 which is movably located therein. As seen in FIG. 2, the frame 12 has a recess 66 at a bottom rear portion of the frame 12. The block-like projection 58 is interlockingly received in the recess 66. The two side upper extensions 54, 56 extend along a portion of the sides of the frame 12.

The trigger guard section 34 extends from the handgrip section 32 in a general single cantilevered beam configuration. More specifically, one end 68 extends from the front of the handgrip section 32 spaced below the top of the handgrip section. The opposite end 70 is a cantilevered free end. In the embodiment shown, the trigger guard section 34 has general "L" shape. This forms an open trigger finger area 72 with the handgrip section 32 and an open gap 74 (see FIG. 3) between the free end 70 and the front of the handgrip section 32. The gap 74 is provided to allow free movement of the trigger 28 therein and, is provided such that the trigger guard section 34 has its general cantilevered configuration. The free end 70 includes an integrally formed pin 76. However, in an alternate embodiment, the pin could be a separate member that is attached to the free end 70 rather than being integrally formed. The pin 76 is generally angled in a forward and upward direction from a flat surface 78 of the free end 70. The flat surface 78 is generally parallel to the top 42 of the handgrip section 32. As described above, the combined handgrip and trigger guard 20 is preferably made of a molded polymer or plastic material. This material preferably has suitable characteristics to allow the trigger guard section 34 to be resiliently deflected. More specifically, because of the general cantilevered configuration of the trigger guard section 34, the section 34 is able to resiliently deflect, at least slightly, in general cantilever fashion.

The frame 12 has a receiving area 80 at the front bottom side. The receiving area 80 has a first section 82 and a second section 84. The first section 82 is suitably sized and shaped to matingly receive the section of the free end 70 with the flat surface 78. The second section 84 is a pin receiving hole having the pin 76 interlockingly located therein. One of the unique features of the present invention is that the free end 70 is not directly fixedly attached to the frame 12. The fastener 44 is the only fastener used to attach the combined handgrip and trigger guard 20 to the frame 12. Thus, the trigger guard section 34 is connected to the frame 12 indirectly by the handgrip section 32 and the fastener 44 and, connected directly to the frame by being merely located in the receiving area 80 without use of additional fasteners directly between the trigger guard section 34 and the frame 12. However, in alternate embodiments, additional fasteners could be used. The shape and dimensions of the combined handgrip and trigger guard 20 have been designed such that, when properly attached to the frame 12, the free end 70 is deflected from its ordinary position. This spring loads or biases the free end 70 against the frame 12. This biasing action and the angled configuration of the pin 76 and hole 84 help to insure that the free end 70 is retained with the frame 12.

The present invention has the advantages of fast and easy assembly and disassembly and, less expensive manufacture and assembly. Only a single fastener is needed to attach the member 20 to the frame 12. Because only one fastener is used, this reduces manufacturing costs. Because only one fastener is used, this reduces assembly time. Because the free end of the trigger guard section is movably mounted to the frame 12 with deflection and a floating type of connection, tolerance mismatches between the member 20 and the frame 12 are greatly reduced. The forces generated by firing the pistol 10 are efficiently transmitted to the member 20 at the block-like projection 58 in the recess 66.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A firearm combined handgrip and trigger guard comprising:

a handgrip section; and a trigger guard section extending from the handgrip section as a single cantilevered bean, a free end of the cantilever trigger guard section being adapted to be connected to a bottom of a frame of a firearm with the cantilever trigger guard section being deflected and spring loaded between the handgrip section and the frame of the firearm.

2. A combined handgrip and trigger guard as in claim 1 wherein the handgrip section and trigger guard section are an integral one-piece member.

3. A combined handgrip and trigger guard as in claim 1 wherein the free end of the trigger guard section has a pin extending therefrom adapted to be located in an aperture of the frame.

4. A combined handgrip and trigger guard as in claim 3 wherein the pin is integral with the trigger guard section and is angled relative to a surface of the free end intended to be located against the frame.

5. A combined handgrip and trigger guard as in claim 1 wherein the handgrip section has a first channel therethrough from a bottom to a top of the handgrip section for locating an elongate fastener therein and a second channel for locating a cartridge magazine therein.

6. A combined handgrip and trigger guard as in claim 2 wherein the handgrip is comprised of a molded polymer material.

7. A combined handgrip and trigger guard for a firearm comprising:

a handgrip section; and a trigger guard section integrally connected with the handgrip section, the trigger guard section having an integral pin section extending therefrom adapted for mounting in an aperture of a frame of the firearm, wherein the trigger guard section has a single general cantilevered "L" configuration with a first end connected to the handgrip section and a second free end.

8. A combined handgrip and trigger guard as in claim 7 wherein the pin section extends from the free end of the trigger guard section.

9. A combined handgrip and trigger guard as in claim 8 wherein the pin section extends from a surface of the free end, that is intended to contact the frame of the firearm, at an angle to the surface.

10. A combined handgrip and trigger guard as in claim 7 wherein the trigger guard section is resiliently deflectable in a general cantilever fashion.

11. A firearm comprising:

a frame; and a one-piece handgrip and trigger guard member, the member having a handgrip section and a trigger guard section, the trigger guard section being connected to the frame indirectly by the handgrip section and, an integral pin on an end of the trigger guard section being directly connected to the frame by being merely located in an aperture of the frame without use of additional fasteners directly between the trigger guard section and the frame.

12. A firearm as in claim 11 wherein the trigger guard section has a general cantilevered configuration from the handgrip section with the end being a free end of the cantilevered configuration.

13. A firearm as in claim 12 wherein the free end of the trigger guard section is spring loaded against the frame by resilient deflection of the free end when the one-piece member is connected to the frame.

14. A firearm as in claim 11 further comprising a single fastener fixedly mounting the handgrip section to the frame, the single fastener passing through the handgrip section.

15. A firearm as in claim 11 wherein the one-piece member has a block-like projection at its top rear that is matingly located in a recess at a bottom rear portion of the frame.

16. A firearm as in claim 11 wherein a top extension of the handgrip section has a notch therethrough with a portion of a slide release movably located in the notch.

17. A firearm as in claim 11 wherein a top extension of the handgrip section has a notch along an interior side adapted to accommodate movement of a magazine release therein.

18. A firearm comprising:

a frame; and a combined handgrip and trigger guard member, the member having a handgrip section and a trigger guard section, the trigger guard section being connected to the frame indirectly by the handgrip section and, a portion on an end of the trigger guard section being directly connected to the frame by being merely located in an aperture of the frame without use of additional fasteners directly between the trigger guard section and the frame.

19. A firearm as in claim 18 wherein the end of the trigger guard section is spring loaded against the frame by resilient deflection of the end when the combined handgrip and trigger guard member is connected to the frame.

20. A firearm as in claim 19 wherein the trigger guard section has a general cantilevered configuration from the handgrip section with the end being a free end of the cantilevered configuration.

21. A firearm as in claim 18 further comprising a single fastener fixedly mounting the handgrip section to the frame, the single fastener passing through the handgrip section.

22. A firearm as in claim 18 wherein the member has a block-like projection at its top rear that is matingly located in a recess at a bottom rear portion of the frame.

* * * * *